US007819288B2

(12) United States Patent
Healy et al.

(10) Patent No.: US 7,819,288 B2
(45) Date of Patent: Oct. 26, 2010

(54) HOUSING AND ACTUATING APPARATUS AND METHODS ASSOCIATED THEREWITH

(75) Inventors: Brian E. Healy, Hartland, WI (US); Allen D. Miller, Racine, WI (US); Nathan R. Westphal, Racine, WI (US); Simon M. Conway, Burlington, WI (US); Scott W. Demarest, Caledonia, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 503 days.

(21) Appl. No.: 10/810,002

(22) Filed: Mar. 26, 2004

(65) Prior Publication Data

US 2005/0211733 A1 Sep. 29, 2005

(51) Int. Cl.
*B65D 83/00* (2006.01)

(52) U.S. Cl. ..... 222/162; 222/174; 222/182; 222/402.15; 222/402.21; 222/402.12; 222/402.13; 239/532; 239/578

(58) Field of Classification Search ..... 222/162, 222/174, 402.1, 402.12–402.15, 402.21, 222/191, 182, 402.22–402.25, 325, 505, 222/507, 608; 239/150, 526, 532, 578
See application file for complete search history.

(56) References Cited

U.S. PATENT DOCUMENTS

| | | | | | |
|---|---|---|---|---|---|
| 2,552,857 | A | * | 5/1951 | Knapp | 222/547 |
| 2,575,124 | A | | 11/1951 | Pollitt | 222/162 |
| 2,673,008 | A | | 3/1954 | Ryan | 222/162 |
| 2,766,913 | A | | 10/1956 | Wilshusen | 222/394 |
| 2,941,700 | A | | 6/1960 | Gable | 222/394 |
| 3,127,065 | A | | 3/1964 | Stevenson | 222/164 |
| 3,128,916 | A | | 4/1964 | Picot | |
| 3,149,761 | A | * | 9/1964 | Harris et al. | 222/323 |
| 3,161,196 | A | | 12/1964 | Berkow | 128/225 |
| 3,247,655 | A | | 4/1966 | Jacob | 56/255 |
| 3,318,492 | A | | 5/1967 | Haas | 222/402.11 |
| 3,351,239 | A | * | 11/1967 | Flock | 222/54 |
| 3,404,814 | A | | 10/1968 | Wakeman | 222/402.13 |
| 3,473,700 | A | * | 10/1969 | Batistelli | 222/174 |
| 3,516,424 | A | | 6/1970 | Eagle | 132/148 |
| 3,608,785 | A | * | 9/1971 | Durso et al. | 222/182 |
| 3,618,833 | A | | 11/1971 | Webster | 222/402.22 |

(Continued)

FOREIGN PATENT DOCUMENTS

EP 0641727 A2 8/1994 ..... 83/14

(Continued)

OTHER PUBLICATIONS

International Search Report and Written Opinion dated Jul. 28, 2005, Appl. No. PCT/US2005/009772.

(Continued)

*Primary Examiner*—J. Casimer Jacyna

(57) ABSTRACT

A combination includes a product container having a longitudinal dimension and a valve oriented to discharge product generally longitudinally therefrom. Valve actuating apparatus extends laterally from the valve in a direction transverse to the longitudinal dimension and terminates at an outer peripheral surface. A housing has a wall that tapers to a discharge opening, and the discharge opening has a size larger than a radius of the container but smaller than the greatest lateral extent of the valve actuating apparatus. The outer peripheral surface is disposed in interfering relationship with the wall when the container is disposed in the housing.

20 Claims, 11 Drawing Sheets

U.S. PATENT DOCUMENTS

| | | | | |
|---|---|---|---|---|
| 3,648,905 | A | 3/1972 | Kauder | 222/402.21 |
| 3,739,941 | A | 6/1973 | Ostrwosky et al. | |
| 3,759,431 | A | 9/1973 | Vos | 222/402.22 |
| 3,760,988 | A | 9/1973 | Ostrowsky | 222/153 |
| 3,871,557 | A | 3/1975 | Smrt | 222/162 |
| 3,884,398 | A | 5/1975 | McLaughlin | 222/402.13 |
| 3,884,399 | A | 5/1975 | Matern | 222/402.13 |
| 3,888,392 | A | 6/1975 | Van Coney | |
| 3,907,175 | A | 9/1975 | Haas | 222/402.13 |
| 3,915,353 | A | 10/1975 | Haas | 222/402.1 |
| 3,946,911 | A | 3/1976 | Morane et al. | 222/402.11 |
| 3,987,942 | A | 10/1976 | Morane et al. | 222/402.15 |
| 4,013,231 | A | 3/1977 | Van Veldhoven | 239/579 |
| 4,077,548 | A | 3/1978 | Beard | 222/321 |
| 4,077,549 | A | 3/1978 | Beard | 222/321 |
| 4,087,027 | A | 5/1978 | Haas | 222/402.13 |
| 4,124,148 | A | 11/1978 | Vieler et al. | 222/321 |
| 4,132,359 | A | 1/1979 | Nozawa | 239/333 |
| 4,138,039 | A | 2/1979 | Micallef | 222/321 |
| 4,186,855 | A | 2/1980 | Edman et al. | 222/321 |
| 4,277,004 | A | 7/1981 | Barlics | 222/402 |
| 4,826,054 | A | 5/1989 | Frutin | 222/402.11 |
| 4,860,932 | A | 8/1989 | Nagy | 222/402.1 |
| 5,139,180 | A | 8/1992 | Lucas | 222/402.13 |
| 5,279,444 | A | 1/1994 | Williams | 222/1 |
| 5,287,998 | A | 2/1994 | Smrt | 222/402.1 |
| D347,263 | S | 5/1994 | Phillips | D23/231 |
| 5,307,959 | A | 5/1994 | Bedore et al. | 222/174 |
| 5,310,096 | A | 5/1994 | Rogers et al. | 222/402.13 |
| 5,335,932 | A | 8/1994 | Nagy | 222/402.13 |
| 5,358,147 | A | 10/1994 | Adams et al. | 222/183 |
| 5,411,184 | A | 5/1995 | Smrt | 222/402.13 |
| 5,503,303 | A | 4/1996 | LaWare et al. | |
| 5,518,148 | A | 5/1996 | Smrt | 222/174 |
| 5,702,036 | A | 12/1997 | Ferrara, Jr. | 222/402.13 |
| 5,743,431 | A | 4/1998 | Brattesani | 222/1 |
| 5,875,926 | A | 3/1999 | Schwartz | 222/79 |
| 5,915,599 | A | 6/1999 | Takahashi | 222/402.13 |
| 5,971,226 | A | 10/1999 | Goncalves | 222/321.6 |
| 5,992,707 | A | 11/1999 | Gaichuk | 222/402.13 |
| 6,003,739 | A | 12/1999 | Bartlett et al. | 222/402.1 |
| 6,004,056 | A | 12/1999 | de Laforcade | 401/190 |
| 6,299,032 | B1 | 10/2001 | Hamilton | 222/402.15 |
| 6,321,742 | B1 | 11/2001 | Schmidt et al. | 126/38 |
| 6,340,103 | B1 | 1/2002 | Scheindel et al. | 222/402.15 |
| 6,386,397 | B2 | 5/2002 | Brotspies et al. | 222/321.6 |
| 6,390,336 | B1 | 5/2002 | Orozco | 222/162 |
| 6,543,653 | B2 | 4/2003 | Lamboux | 222/321.8 |
| 6,551,001 | B2 | 4/2003 | Aberegg et al. | 401/190 |
| D474,403 | S | 5/2003 | Fahy et al. | D9/448 |
| 6,569,387 | B1 | 5/2003 | Furner et al. | |
| 6,588,631 | B2 | 7/2003 | Sanchez | 222/402.13 |
| 6,592,011 | B1 | 7/2003 | Lammel et al. | |
| 2003/0006252 | A1 * | 1/2003 | Henry et al. | 222/402.1 |
| 2004/0028458 | A1 | 2/2004 | Heathcock et al. | 401/190 |
| 2004/0188473 | A1 | 9/2004 | Groh et al. | 222/402.13 |
| 2004/0222245 | A1 | 11/2004 | Marroncles | 222/402.13 |

FOREIGN PATENT DOCUMENTS

| | | | |
|---|---|---|---|
| WO | WO 01/26995 | 4/2001 | |
| WO | WO 03/024836 | 3/2003 | 83/16 |
| WO | WO 03/103760 | * 12/2003 | |

OTHER PUBLICATIONS

International Search Report and Written Opinion dated Jul. 28, 2005, Appl. No. PCT/US2005/009772.
U.S. Appl. No. 10/877,162, Office Action dated Nov. 8, 2006.
U.S. Appl. No. 10/941,791, Office Action dated Apr. 6, 2007.
U.S. Appl. No. 10/877,162, Office Action dated Apr. 17, 2007.
U.S. Appl. No. 11/007,070, Office Action dated Jun. 1, 2007.
U.S. Appl. No. 11/006,930, Office Action dated Jun. 1, 2007.

* cited by examiner

HOUSING AND ACTUATING APPARATUS AND METHODS ASSOCIATED THEREWITH

TECHNICAL FIELD

The present invention relates generally to housings that hold containers, and more particularly to housings that hold containers and actuators that actuate valve apparatus to dispense product from the container.

BACKGROUND

Various apparatus for dispensing product from a container or reservoir of product have been developed. Smrt U.S. Pat. No. 5,287,998 discloses an actuator fitted to a container and including an axially extending passage therethrough for discharging product. The actuator includes a pair of wings that extend transversely from the actuator. The container may be moved axially within a device such that the wings bear against a surface defining a passage, thereby discharging product through the passage.

Brotspies et al. U.S. Pat. No. 6,386,397 discloses a spray bottle grip used with a nasal spray bottle. The grip is coupled to a reciprocating nozzle of the spray bottle, and two arms extend downwardly along the spray bottle. The arms include finger flanges that provide an ergonomic means of reciprocating the nozzle to dispense product from the spray bottle.

Haas U.S. Pat. No. 3,318,492 discloses a disc-shaped actuator attached to a nozzle of a container. A user may depress the actuator with her finger to dispense product from the container.

Scheindel et al. U.S. Pat. No. 6,340,103 discloses a handle extending along a container body. When a user pulls the handle toward the container body, a portion of the handle pushes downwardly upon a nozzle portion of the container to dispense product from the container.

Micallef U.S. Pat. No. 4,138,039 discloses a container having a vertically reciprocating tubular pump. A cap is fitted to the container and includes an actuator button extending from a sidewall of the cap. Movement of the actuator button in a direction toward the sidewall of the cap is translated into perpendicular reciprocating movement of the pump.

Other patents disclose devices having a container of product disposed at a first end of a rod and having a trigger mechanism at a second end of the rod wherein a user may actuate the container from a distance. Discharging product from a distance can be an advantage for many purposes, such as accessing hard-to-reach places or perhaps for discharging an insecticide into a hornet nest without placing oneself too close to the nest. Smrt U.S. Pat. No. 5,518,148 discloses a device where an actuating rod has a trigger on a first end and a container on a second end. Pulling the trigger moves the actuating rod longitudinally such that the second end of the rod moves a bell crank, which in turn, moves an additional rod that actuates a valve on the container. Aberegg et al. U.S. Pat. No. 6,551,001, assigned to the assignee of the present application and the disclosure of which is incorporated by reference herein, discloses a cleaning device having a trigger at a first end of a rod and a mop cleaning head and a container at a second end of the rod. Pulling the trigger moves a pivot link, which in turn actuates a valve of the container, thereby discharging product from the container onto the surface to be cleaned by the mop cleaning head.

Adams et al. U.S. Pat. No. 5,358,147, assigned to the present assignee and also incorporated herein by reference, discloses a container of air freshener inserted into a shroud. The shroud includes a nozzle that is fitted over a valve stem of the container. The combination of the container and the shroud is placed within a housing. When a user wishes to spray air freshener into ambient air, the user pushes the housing, which in turn pushes the shroud and the valve stem to dispense the air freshener out of the housing.

SUMMARY OF THE INVENTION

In accordance with one aspect of the present invention, a combination includes a product container having a longitudinal dimension and a valve oriented to discharge product generally longitudinally therefrom. Valve actuating apparatus extends laterally from the valve in a direction transverse to the longitudinal dimension and terminates at an outer peripheral surface. A housing has a wall that tapers to a discharge opening, and the discharge opening has a size larger than a radius of the container but smaller than the greatest lateral extent of the valve actuating apparatus. The outer peripheral surface is disposed in interfering relationship with the wall when the container is disposed in the housing.

A further aspect of the present invention comprehends an actuator cap having a main wall that extends generally along an axial dimension thereof and has a varying cross sectional size. An actuator member extends transversely to the axial dimension and ends in an outer peripheral surface that extends laterally beyond a portion of the main wall, but does not extend beyond a greatest lateral extent of the main wall.

According to another aspect of the present invention, an actuator cap includes a main wall that extends generally along an axial dimension thereof and has a varying cross sectional size. An actuator member is movable relative to the main wall and has an outer peripheral surface extending laterally beyond the main wall at the axial location of the outer peripheral surface.

According to a further aspect of the present invention, an actuator cap includes a main wall having an axial dimension and tapering between first and second ends. An actuator member extends transversely to the axial dimension and ends in an outer peripheral surface that extends laterally beyond a portion of the main wall at the axial location of the outer peripheral surface. The actuator member is disposed intermediate the first and second ends.

A further aspect of the present invention comprehends a method of dispensing including the step of selecting a container of product having a longitudinal dimension, a valve actuable to dispense product generally parallel to the longitudinal dimension, and valve actuating apparatus extending from the valve in a direction transverse to the container's longitudinal dimension and terminating at an outer peripheral surface. A housing is selected having a wall that reduces in cross sectional size to a discharge opening that has a size larger than a radius of the container. However, the opening is small enough so that the wall provides an interfering relationship with the outer peripheral surface when the container is placed into the housing. A relative movement of the container and the housing is provided in a direction along the longitudinal dimension such that the outer peripheral surface contacts a surface of the wall, thereby displacing the valve actuating apparatus to dispense product from the housing.

A further aspect of the present invention envisions a method of providing apparatus to an end user that includes the step of providing a container of product having a longitudinal dimension and valve actuating apparatus extending in a direction transverse to the longitudinal dimension and terminating at an outer peripheral surface. The container is delivered or caused to be delivered to the end user. The container and the valve actuating apparatus are identified as suitable for placement within a housing that has a wall that tapers to a discharge opening having a size larger than a radius of the container but small enough to provide an interfering relationship between the wall and the valve actuating apparatus. Product can be dispensed by moving the container and the housing relative to each other in a direction along the longitudinal dimension to displace the valve actuating apparatus against a surface of the wall.

Other aspects and advantages of the present invention will become apparent upon consideration of the following detailed description.

DESCRIPTION OF THE PREFERRED EMBODIMENTS

Figure 1A:
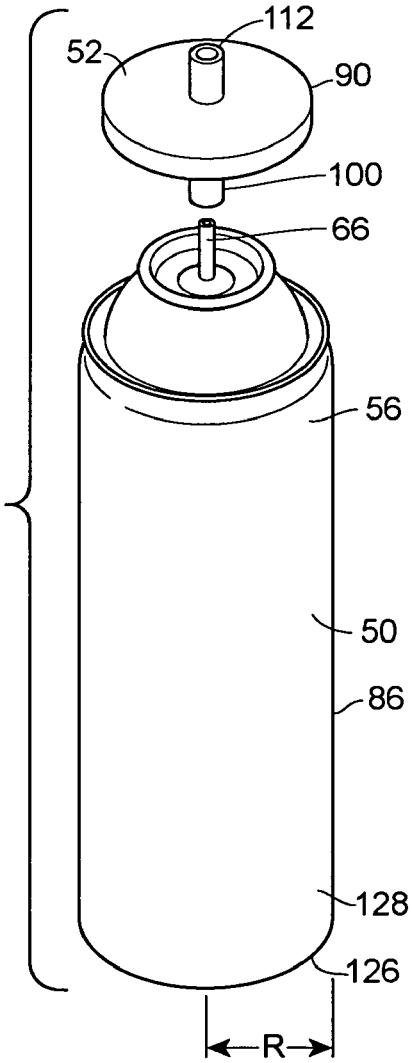
FIG. 1A is an exploded isometric view of a container and valve actuating apparatus.
Figure 2:
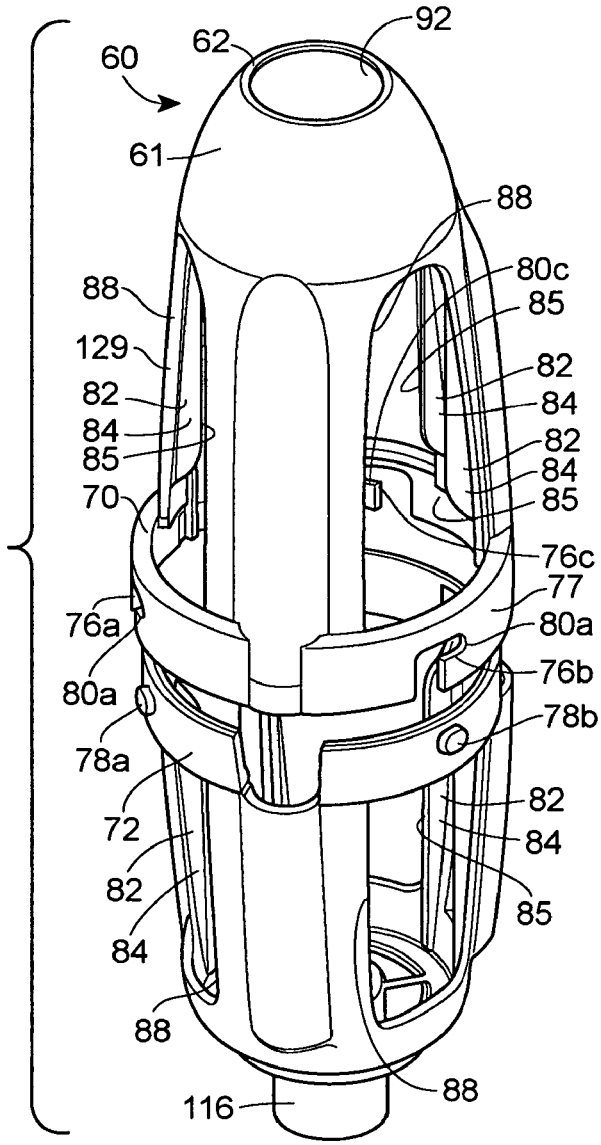
FIG. 2 is an exploded isometric view of a housing into which the container of FIG. 1A may be placed.
Figure 1B:
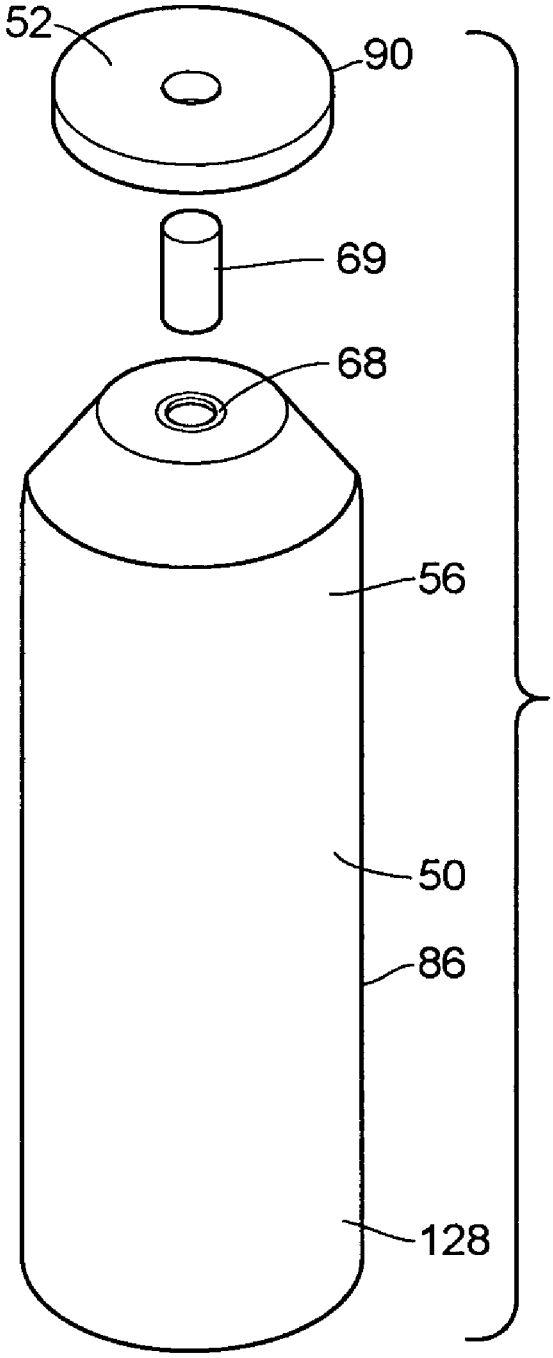
FIG. 1B is an exploded isometric view showing a container having a female-type receiver valve.
Figure 1C:
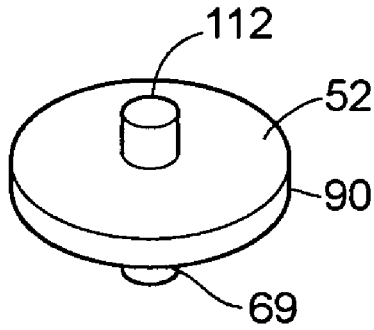
FIG. 1C is an isometric view of valve actuating apparatus.

FIG. 1A illustrates a container 50 and a valve actuating apparatus 52 actuable to dispense product from the container 50. The container 50 includes a main container body 56 that contains product. Referring to FIG. 2, a housing 60 is provided, in which the container 50 may be placed. The housing 60 includes a wall 61 that decreases in cross sectional size, tapering to a discharge opening 62. The discharge opening 62 has a cross sectional size greater than a radius R of the container 50. The container 50 includes a valve stem 66 that actuates a valve (not shown) disposed within the container body 56, and product flows from the valve stem 66 in a direction substantially parallel to an axial dimension of the container 50. The valve stem 66 could be either a vertically depressible valve stem or a tilt valve stem. As will be appreciated hereinafter, if a tilt valve stem is utilized such stem could also alternatively be depressed vertically without tilting to dispense product therethrough. Referring to FIG. 1B, one could substitute the valve stem 66 with a female valve 68 that receives a suitable insertion tube 69. As shown in FIG. 1C, the insertion tube 69 could be integral with or secured to the valve actuating apparatus 52. Alternatively, the valve actuating apparatus 52 could be separable from the insertion tube 69. Similarly, it should be evident that the valve actuating apparatus 52 could be separable from the valve stem 66 or could be secured in fixed relation thereto or could be integral therewith. Referring again to FIG. 2, the housing 60 may include first and second wall portions 70, 72 that may be joined together to house the container 50. The portion 70 may include three bayonet slots 76*a*-76*c* disposed on an end 77 of the portion 70 and equally spaced from one another by 120 degrees. To join the portions 70, 72, a user inserts pins 78*a*-78*c* carried by an end 79 of the portion 72 into the slots 76*a*-76*c* and provides a relative rotation of the portions 70, 72 to seat the pins 78*a*-78*c* within recessed regions 80*a*-80*c* of the slots 76.

Either of the portions 70, 72 may include protrusions 82 such as guide fins 84 having edges 85 that abut an exterior surface 86 of the container 50 when the container 50 is placed therein to center the container 50 within the housing 60. Either of the portions 70, 72 may include elongate openings or windows 88 that allow a user to see the container 50 when the container is disposed within the housing 60. The windows 88 further provide an advantage in that the user may see written directions or graphics disposed on the container 50.

Figure 1D:
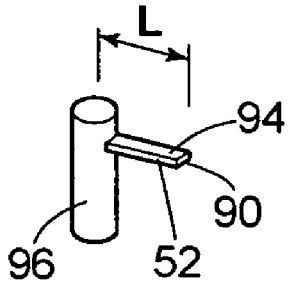
FIG. 1D is an isometric view of a valve stem having an arm extending therefrom.
Figure 3:
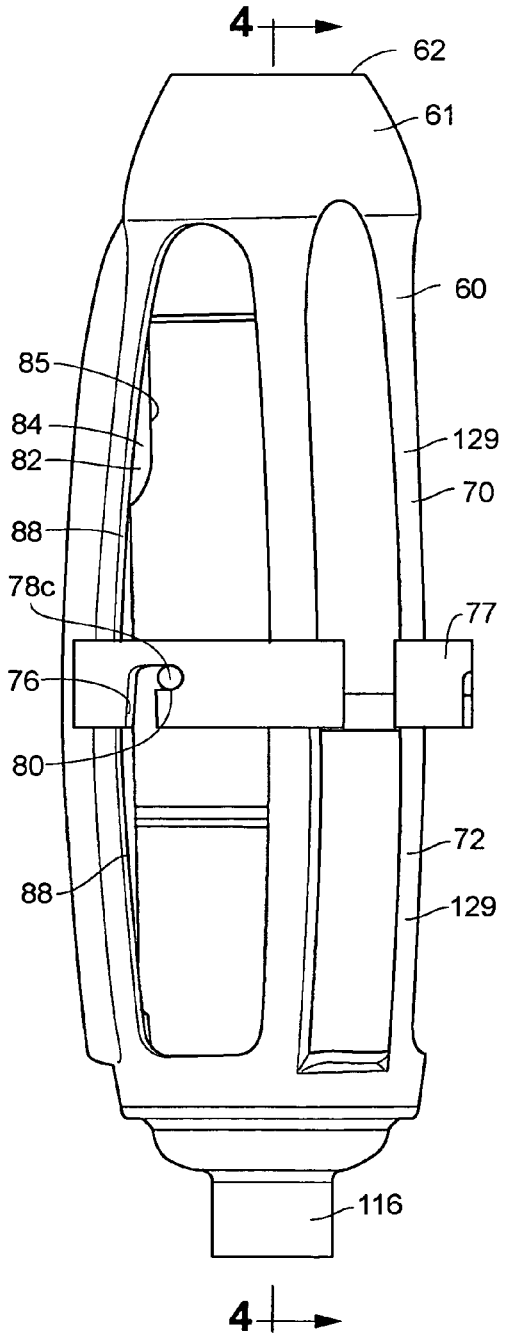
FIG. 3 is a side elevational view of the housing of FIG. 2.
Figure 4:
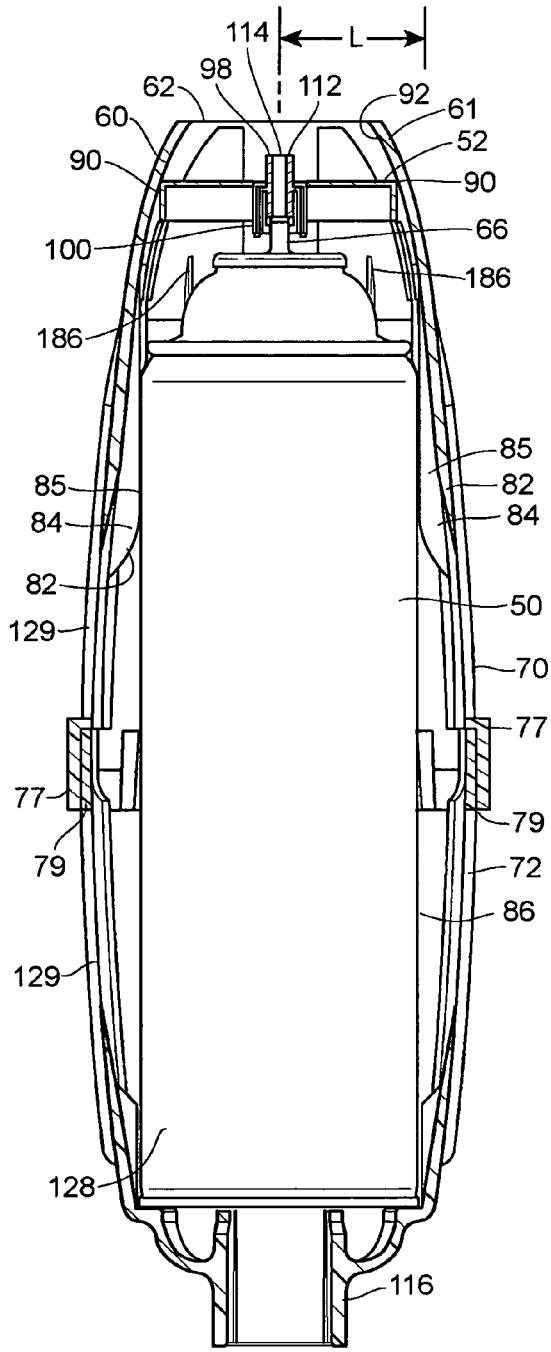
FIG. 4 is a sectional view taken generally along the lines 4-4 of FIG. 3 further illustrating the container of FIG. 1 in elevation.
Figure 5:
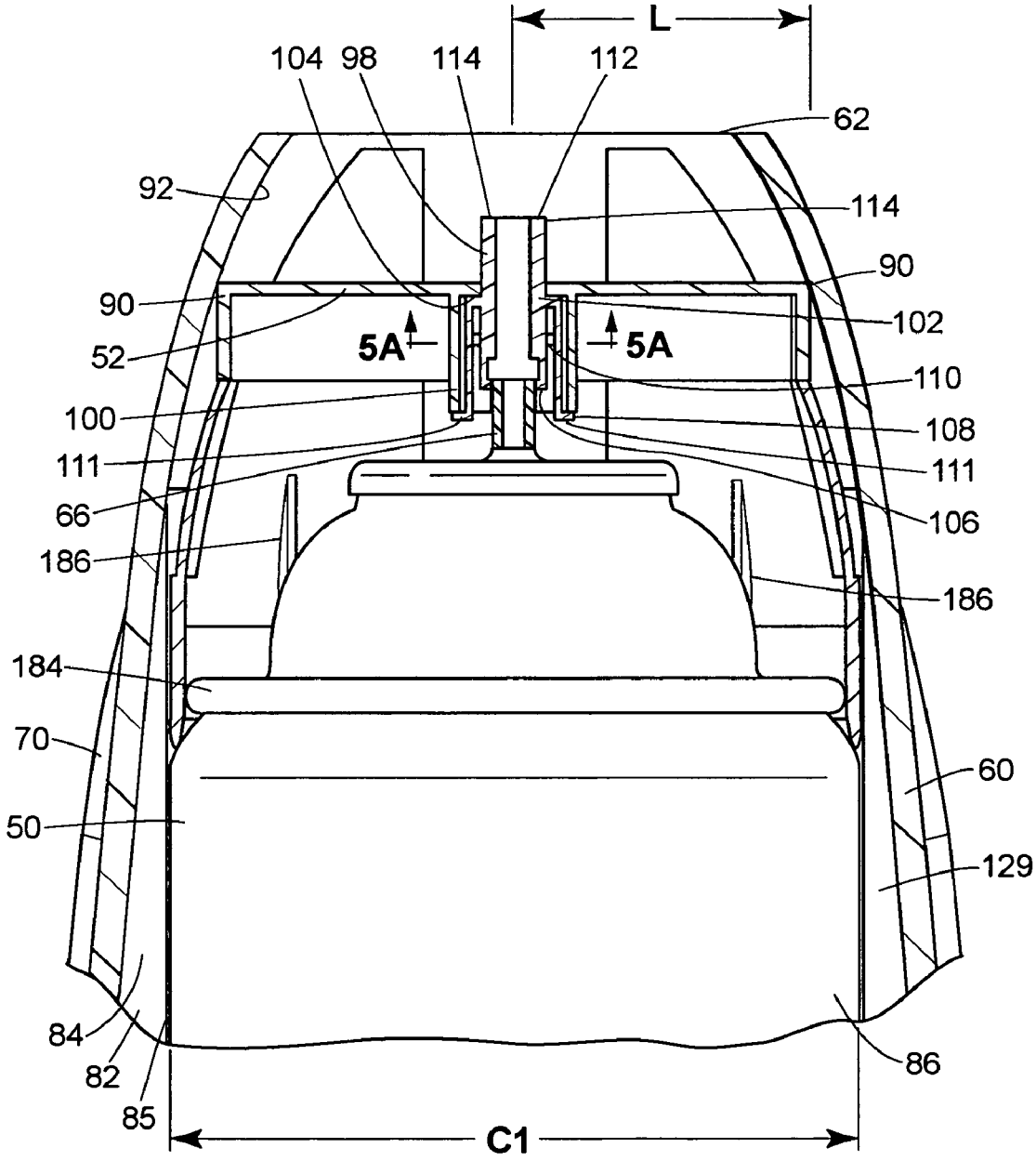
FIG. 5 is an enlarged fragmentary view of FIG. 4.

Referring to FIGS. 4 and 5, the valve actuating apparatus 52 extends in a direction transverse to a longitudinal dimension of the container 50. The valve actuating apparatus 52 has a length L defined between a center of the valve stem 66 and an outer peripheral surface 90 of the valve actuating apparatus 52. As seen in FIG. 5, the length L is selected relative to the inner dimensions of the wall 61 such that the outer peripheral surface 90 is disposed in interfering relationship with the wall 61. Relatively moving the container 50 and the housing 60 such that the main body 56 of the container 50 and the discharge opening 62 are moved toward each other causes the outer peripheral surface 90 to contact a surface 92 of the wall 61, thereby displacing the valve actuating apparatus 52 and dispensing product out of the discharge opening 62. It should be appreciated that the valve actuating apparatus 52 could be of any suitably shaped structure. For example, referring to FIG. 1D, the valve actuating apparatus 52 could include a single arm 94 having at least a portion of length L and extending from a tilt-type valve stem 96.

Figure 5A:
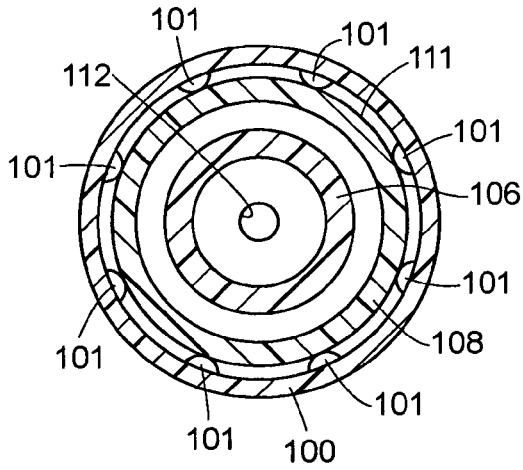
FIG. 5A is an enlarged sectional view taken generally along the lines 5A-5A of FIG. 5.
Figure 6:
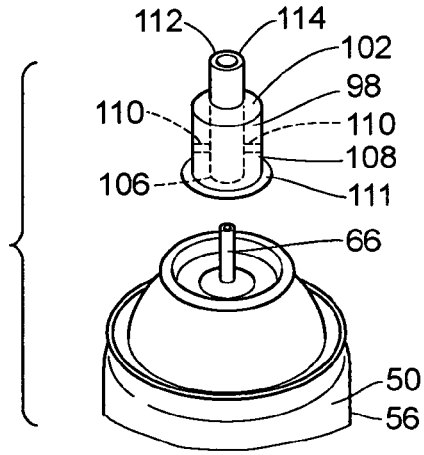
FIG. 6 is a fragmentary exploded isometric view illustrating a nozzle that may be fitted to a valve stem.
Figure 7:
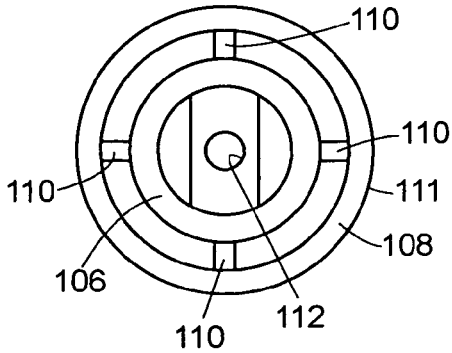
FIG. 7 is an enlarged bottom elevational view of the nozzle of FIG. 6.

Referring to FIGS. 5-7, a nozzle 98 may be fitted to the valve stem 66 and the nozzle 98 may be fitted within a bore defined by a circumferential wall 100 of the valve actuating apparatus 52. The nozzle 98 includes a shoulder 102 that abuts a bearing surface 104 of the valve actuating apparatus 52. Referring to FIG. 5A, the wall 100 may include ribs 101 extending therefrom that engage the wall 108. In addition, the wall 100 may be tapered to facilitate insertion of the nozzle 98 therein. The nozzle 98 may include an inner circumferential wall 106 defining a flow passage and surrounded by an outer circumferential wall 108 connected to the inner circumferential wall 106 by radially extending members 110. The nozzle 98 may also have a flange 111 that abuts a lower periphery of the circumferential wall 100 as seen in FIG. 5. An outlet 112 is located at a discharge orifice 114 of the nozzle 98. Various conventional internal features can be selected so as to impart a desired spray characteristic to product discharged from the nozzle 98. Nozzles such as nozzle 98 are commercially available from Summit Packaging Systems, Inc. of Manchester, N.H.

Figure 8:
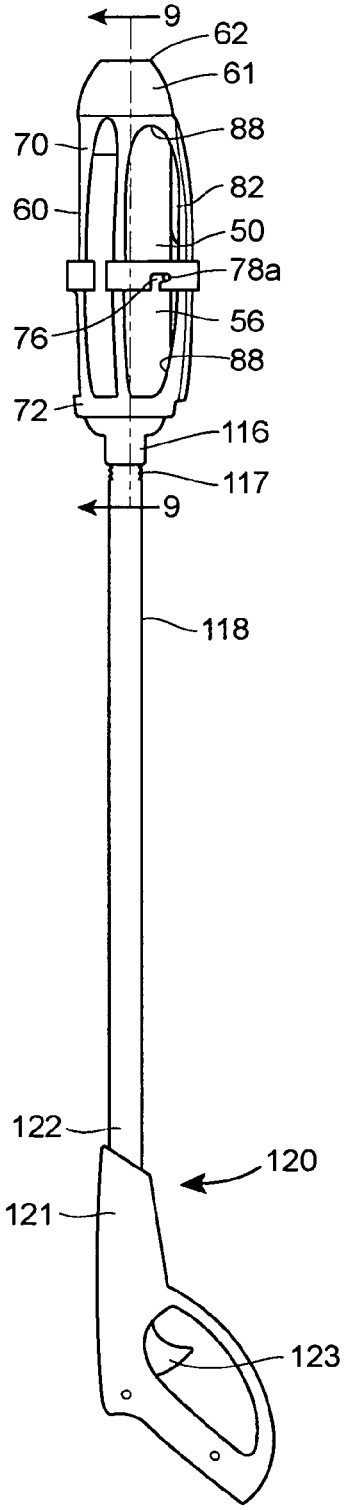
FIG. 8 is a side elevational view showing a rod and trigger mechanism in combination with the housing of FIG. 3.
Figure 9:
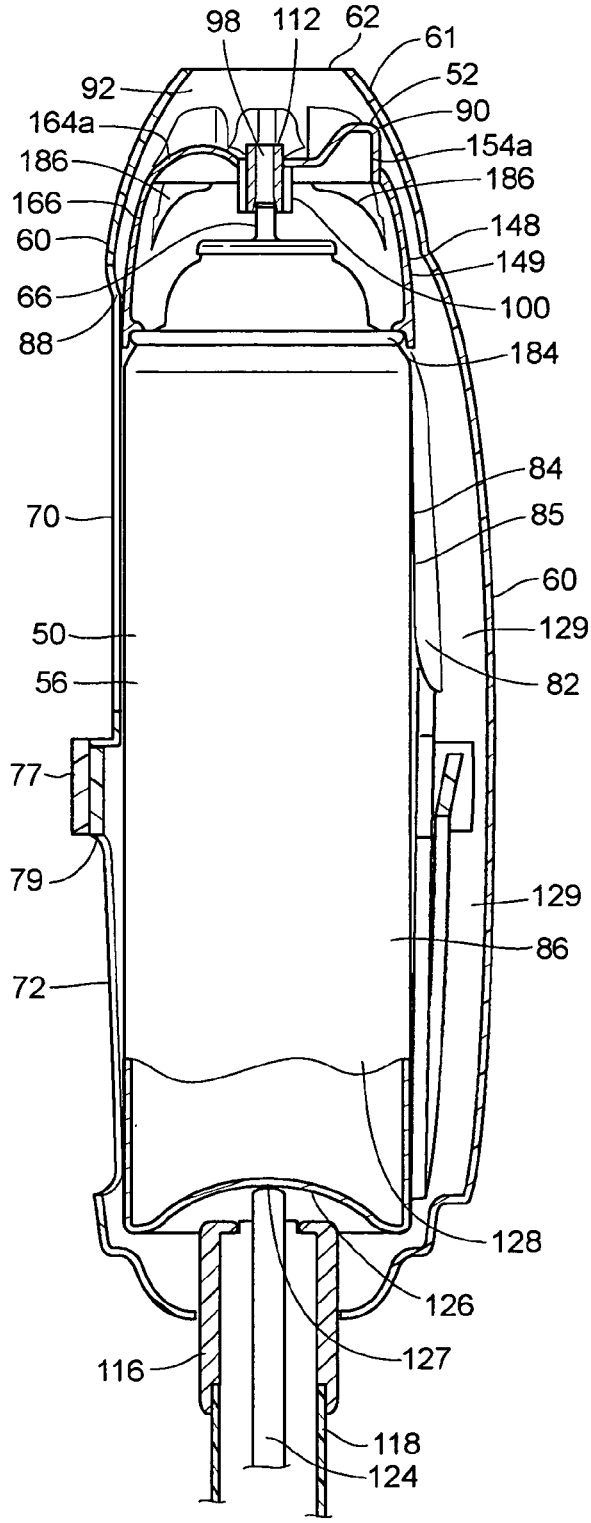
FIG. 9 is a fragmentary partial sectional view taken generally along lines 9-9 of FIG. 8.

Referring to FIGS. 8 and 9, the housing 60 includes a sleeve 116 attached by any suitable means to a first end 117 of a hollow tube 118 of a rod and trigger mechanism 120. A handle assembly 121 is secured by any suitable means to a second end 122 of the hollow tube 118. Pulling a trigger 123 of the handle assembly 121 advances a push rod 124 (FIG. 9) disposed within the tube 118 against a bottom surface 126 of the container 50, thereby advancing the valve actuating apparatus 52 toward the discharge opening 62 to dispense product from the housing 60. If necessary or desirable, an end 127 of the push rod 124 may be shaped and/or fitted with a plate or other member to distribute forces more evenly across the bottom surface 126 of the container 50. Further, if desired, rather than moving the container 50 relative to the housing 60 by using one or more intermediate members one could manually move the container 50 and/or the housing 60 relative to one another to dispense product.

Referring again to FIG. 5, a main region 129 of the wall portions 70 and 72 may have an inner cross sectional size Cl of about 66 mm, and thus the container 50 could have a cross sectional size of up to about 66 mm. In this regard, while a range of sizes is available for the container 50 one might wish to provide a container sized at or near maximum to provide a maximum useful life for the container 50 given the available space within the housing 60. One could select any suitable size for the discharge opening 62, such as a cross sectional size of about 34 mm, and suitable values of L might range between about 18 mm and about 33 mm to provide the above-described interfering relationship. A preferred value for L is about 25 mm.

The product stored within the container body 56 could be any of a broad variety of products such as an air freshener, an insect control agent, a hair spray, a cleaning agent, a polishing agent, a fragrance, or other any other product stored in a container. Further, the product may be pressurized by a suitable propellant disposed within the container 50.

Figure 10:
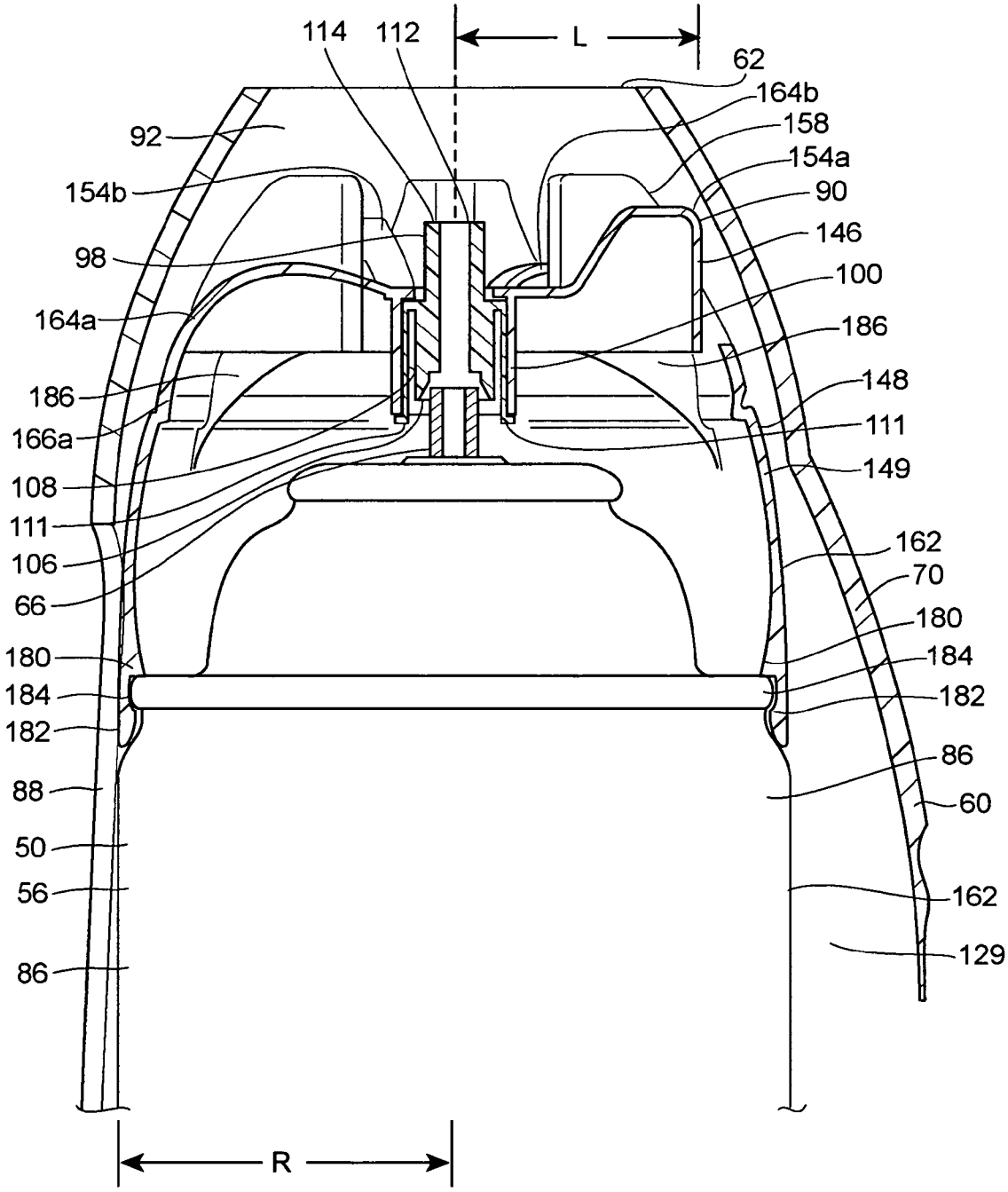
FIG. 10 is an enlarged fragmentary view of a portion of the apparatus of FIG. 9.
Figure 11:
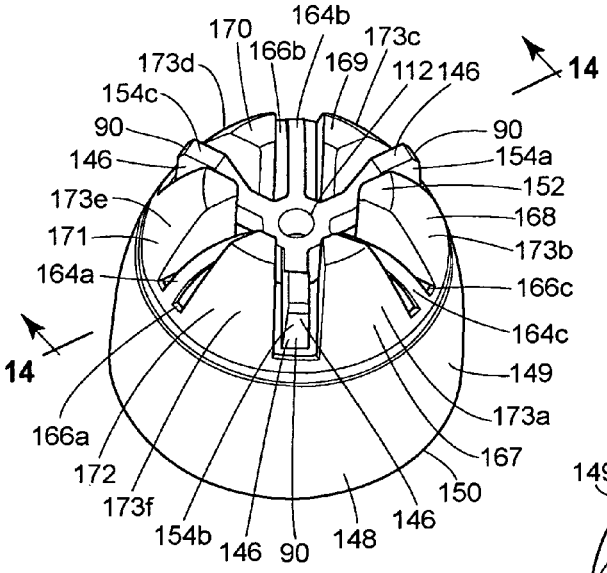
FIGS. 11 and 12 are top and bottom isometric views, respectively, of the actuator cap of FIG. 10.
Figure 12:
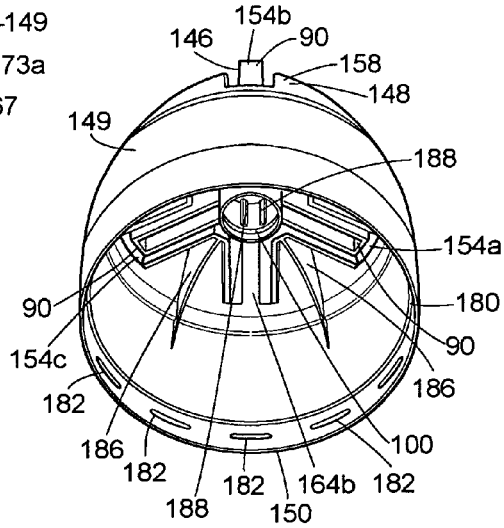
Figure 13:
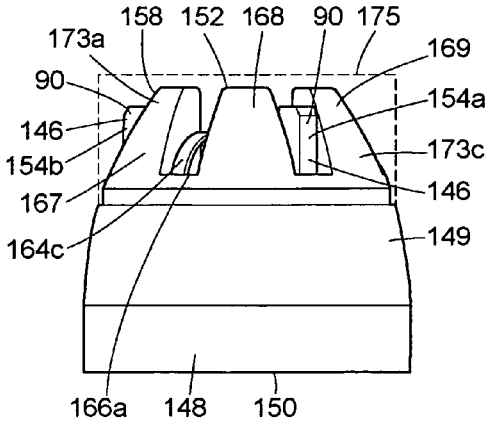
FIG. 13 is a side elevational view of the actuator cap of FIG. 9 showing an optional cover in phantom lines.
Figure 14:
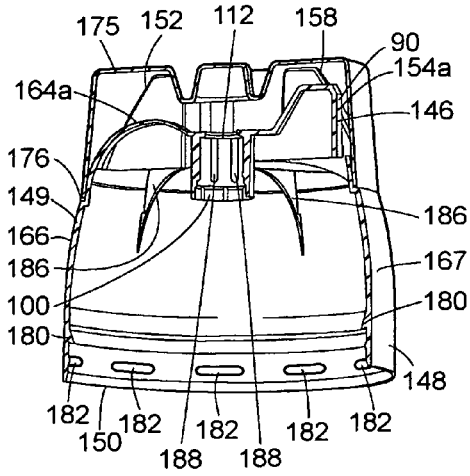
FIG. 14 is a sectional view taken generally along the lines 14-14 of FIG. 11.
Figure 15:
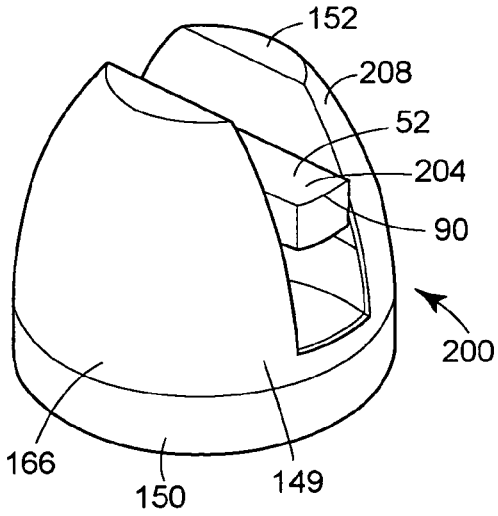
FIGS. 15 and 16 are front and rear isometric views, respectively, of a second actuator cap.

FIGS. 10-14 illustrate a further embodiment of valve actuating apparatus 146 wherein structures common to previous embodiments are assigned like reference numerals. FIG. 11 shows the valve actuating apparatus 146 incorporated in an actuator cap 148 that may be fitted onto the container 50. A main wall 149 of the cap 148 decreases in cross sectional size along an axial dimension defined between first and second ends 150, 152, tapering from the end 150 to the end 152. Referring also to FIG. 10, a first arm 154*a* is integral with the wall 100 surrounding the nozzle 98 and has a length L as measured between the surface 90 and the center of the valve stem 66. The center of the valve stem 66 is substantially coincident with the center of the actuator cap 148. FIG. 10 shows that a portion of the inner circumferential wall 106 of the nozzle 98 may be tapered to facilitate insertion of the valve stem 66 therein. The arm 154*a* extends in a direction transverse to the axial dimension such that the surface 90 is disposed beyond a portion 158 of the main wall 149. When the cap 148 is fitted to the container 50, one or both of the cap 148 and the container 50 define an outermost periphery 162, and the arm 154*a* preferably (although not necessarily) does not extend beyond the outermost periphery 162. A flexible strap member 164*a* extends from the circumferential wall 100 in a direction opposite the arm 154*a*. Referring to FIG. 11, additional arms 154*b*, 154*c* may be provided, and the arms 154*a*-154*c* are spaced apart by 120°. Strap members 164*b*, 164*c* extend in diametrically opposite directions to the arms 154*b*, 154*c*. The arms 154*a*-154*c* are cantilevered from the circumferential wall 100, and the arms 154 and the straps 164 form a monolithic structure attached to the main wall 149 only at areas 166*a*-166*c* of the main wall 149. The straps 164 and the arms 154 are disposed in recesses defined between upright portions 167-172 of the cap 148. The actuator cap 148 provides a useful centering function in that exterior surfaces 173*a*-173*f* of the upright portions 167-172, respectively, maintain the point of discharge 112 of the actuator cap 148, best seen in FIGS. 10 and 11, in a centrally located position relative to the discharge opening 62, thereby minimizing the potential for product impingement against the surface 92 of the wall 61. Referring to FIGS. 13 and 14, a cover 175 may be placed over the cap 148 to prevent inadvertent actuation during shipment.

FIG. 14 shows that the actuator cap 148 may include a circumferential inwardly-tapered flange 180 and a plurality of spaced apart inwardly-directed beads 182. As shown in FIG. 10, the flange 180 and the beads 182 are snap fitted over a rim 184 of the container 50 such that the rim 184 is captured between the flange 180 and the beads 182 so that the actuator cap 148 is captured on the container 50.

FIGS. 12 and 14 show arcuate gussets 186 that provide rigidity to the wall portions 167-172. FIG. 14 shows ribs 188 that may be provided within the circumferential wall 100 to engage the exterior surface of the valve stem 66 or of the nozzle 98 fitted to the valve stem 68. The ribs 188 aid in centering the nozzle 98 and also provide slightly flexible contact points between the circumferential wall 100 and the nozzle 98, accommodating minor variances in the size of either part.

Figure 16:
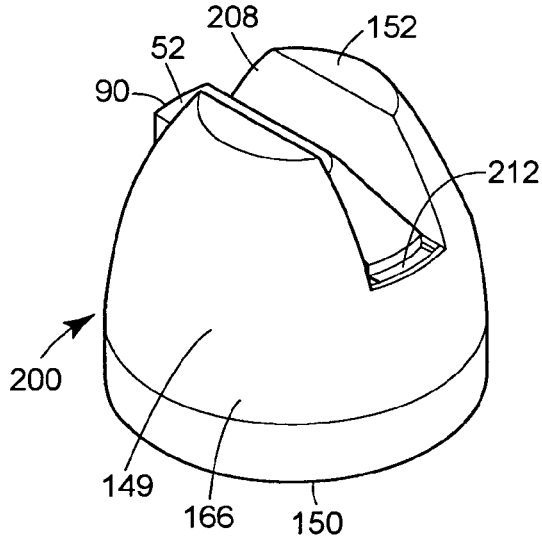
Figure 17:
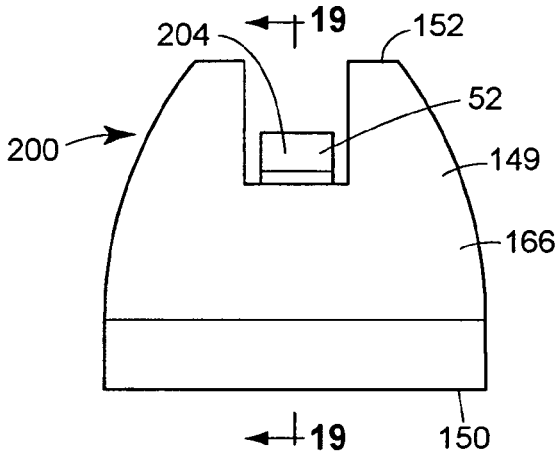
FIGS. 17 and 18 are rear and side elevational views, respectively, of the cap of FIGS. 15 and 16.
Figure 18:
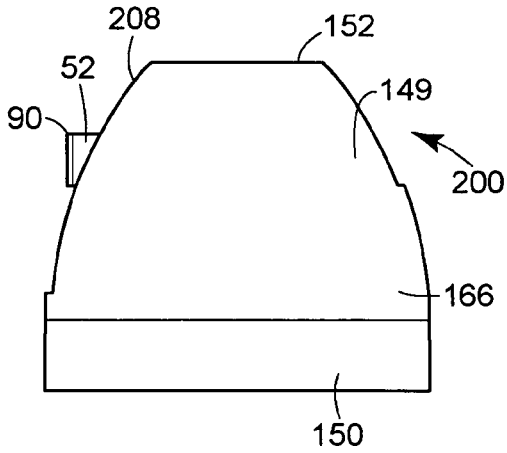
Figure 19:
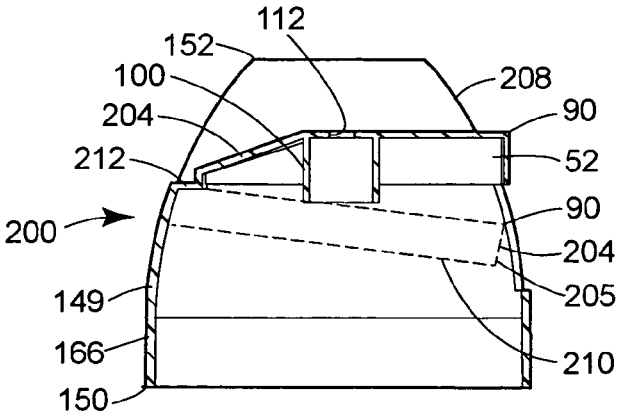
FIG. 19 is a sectional view taken generally along the lines 19-19 of FIG. 17.

FIGS. 15-19 show an alternative actuator cap 200 having an arm in the form of a lever member 204. The lever member 204 extends in a direction transverse to the axial dimension and terminates at the outer peripheral surface 90, which is disposed beyond a portion 208 of the wall 149 of the cap 200. However, the lever member 204 preferably does not extend transversely beyond an outer diameter of the first end 150. Referring to FIGS. 16 and 19, the lever member 204 is pivotable about a hinge portion 212 connected to the wall 149. The surface 90 of the lever member 204 traverses an arcuate path as the lever member 204 is pivoted downwardly. At a point represented by a phantom line 210, the surface 90 does not extend beyond any portion of the wall 149 such that the lever member 204 cannot move downwardly more than a particular distance owing to the fact that the lever member 204 is shielded by the wall 149. Therefore, when the cap 200 is disposed on the container 50 it is not possible to deflect the lever member 204, and hence the valve stem 66, more than the particular distance.

Figure 20:
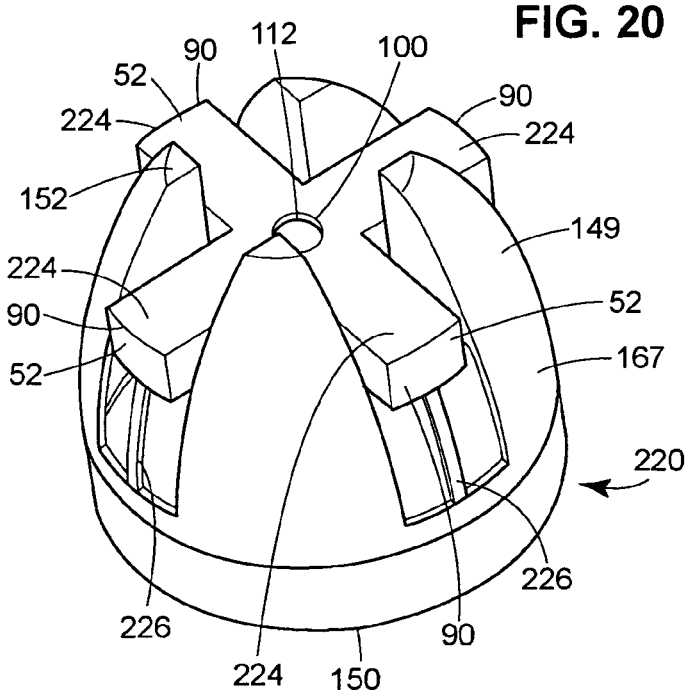
FIGS. 20 and 21 are isometric and elevational views, respectively, of a third actuator cap.
Figure 21:
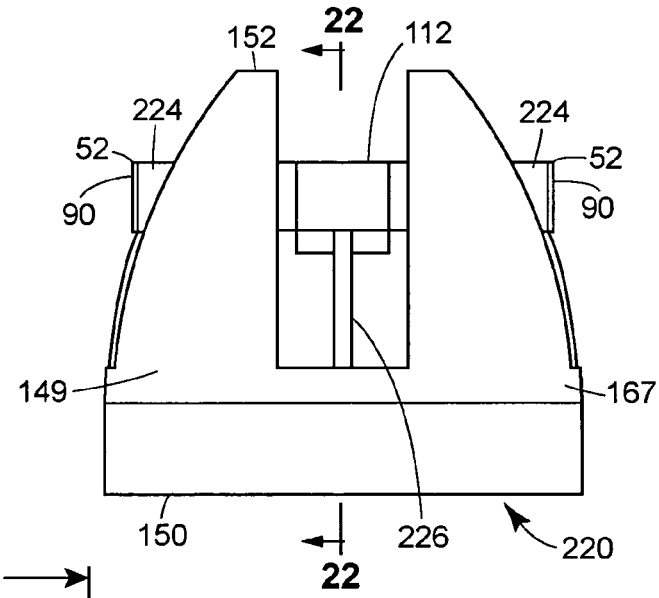
Figure 22:
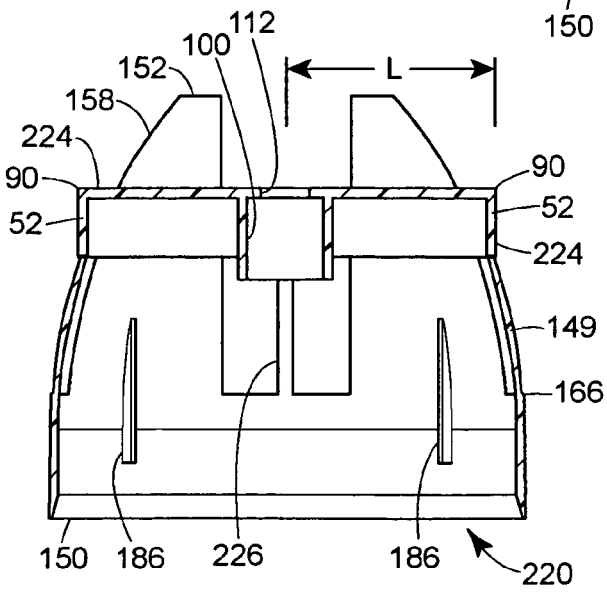
FIG. 22 is a sectional view taken generally along the lines 22-22 of FIG. 21.

FIGS. 20-22 show another actuator cap 220 having a plurality of arms 224 radiating from the circumferential wall 100, and thus a plurality of the surfaces 90 are provided at circumferentially spaced positions. Providing a plurality of the surfaces 90 at spaced apart positions, such as 180°, ensures substantially axial reciprocating movement of the valve stem 66, rather than tilting movement, potentially minimizing product discharge against the wall 61 of the housing 60. Each of the plurality of the arms 224 may be connected to the cap 220 by any suitable means such as flexible tethers or straps 226 that flex outwardly or inwardly when the arms 224 are pushed toward the container 50.

Figure 23:
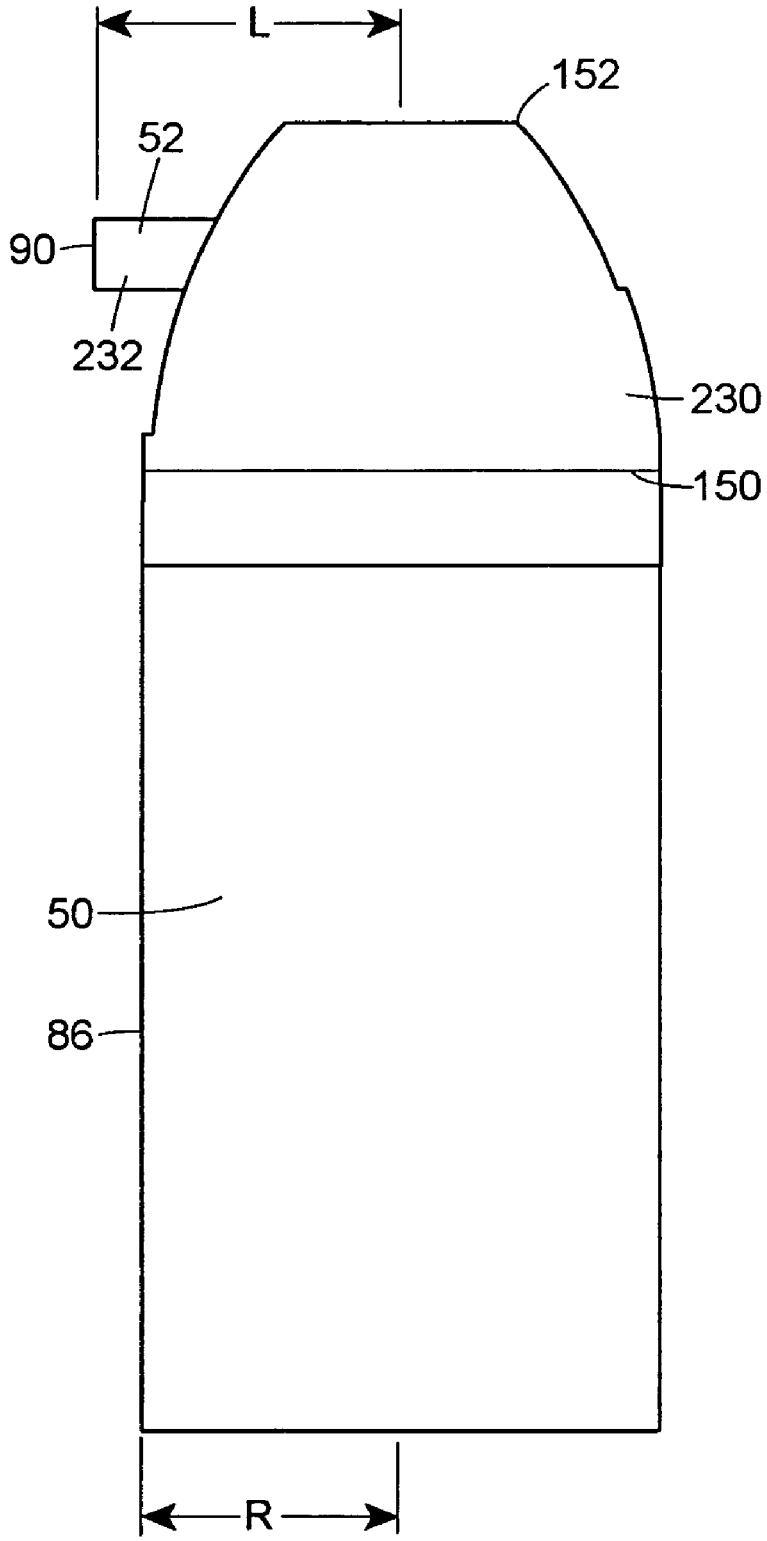
FIG. 23 is a side elevational view of a fourth actuator cap disposed on a container.

FIG. 23 illustrates an actuator cap 230 having an arm 232 that extends laterally beyond the exterior surface 86 of the container 50 and also laterally beyond the maximum radial dimension of the actuator cap 230. It should be evident from FIG. 23 that the valve actuating apparatus 52 could extend laterally beyond either or both of the maximum radial dimension of the actuator cap 230 and the container 50.

The foregoing embodiments may provide one or more of the following advantages. First, because the valve actuating apparatus 52 has a sufficiently large value of L, preferably having any suitable value greater than about one half the container radius R, the valve actuating apparatus 52 is usable with the housing 60 to dispense product therefrom even though the discharge opening 62 is large. (As noted above, the cross sectional size of the discharge opening 62 is greater than the container radius R.) Containers lacking an actuating apparatus of the length L as defined previously are not usable with the housing 60. This may be useful because containers lacking the required valve actuating apparatus 52 may not be designed for use with the housing 60 or the housing 60 may not be marketed for use with a particular container of product that lacks the valve actuating apparatus 52. For example, the housing 60 may be marketed for use with a container of a specific type of insecticide sold with the valve actuating apparatus 52. In addition, a longer L value may be advantageous from a manufacturing tolerance standpoint because it may be easier to control tolerances of L for a large valve actuating apparatus rather than a small valve actuating apparatus having a smaller tolerance range. A further advantage of the large discharge opening 62 and large value of L is that contact near the outlet 112 is avoided. Because the wall 61 contacts the outer peripheral surface 90 at the distance L from the orifice of the valve stem 66, the potential for product obstruction or impingement minimized. This feature could be especially advantageous for some products that fan out while discharging from the container 50 as the product gets farther away from the container 50. The large cross sectional size of the wall 61 would accommodate such fanning out while minimizing product impingement or deposition thereupon. A further advantage of the large discharge opening 62 is that the surface 92 of the wall 61 may be easily manually accessed for cleaning. Regarding the embodiment of FIGS. 15-19, because the length L is selected relatively long, the lever arm 204 has significant mechanical advantage at least according to this embodiment. A further optional advantage of the large value of L is that the valve actuating apparatus 52 may be easily displaced by hand if a user removes the container 50 from the housing 60 and manually displaces same. In this regard, the relative large value of the length L allows the user to maintain her hands away from product discharging from the container 50 in the event of such manual actuation. Also, the large size of the discharge opening 62 may require less material to construct the housing 60, and hence less cost.

A dispensing method may include providing the container 50 as shown in FIGS. 4 and 5 and placing same within the interior space defined by the housing 60. The container 50 is advanced axially toward the discharge opening 62 such that the peripheral surface 90 pushes against the wall 61, thereby actuating the valve apparatus 52 and dispensing product from the housing 60.

In addition, one might also practice methods of providing actuating apparatus to an end user. In a first method of providing apparatus to an end user, one may provide the container 50 and the valve actuating apparatus 52 and then deliver these to an end user through any suitable form of delivery or distribution, whether by distribution through stores, promotional events, United States mail, common carrier, or other suitable sales or distribution channels. It should be noted that the container 50 and the valve actuating apparatus 52 need not be sold to a consumer in every instance, but either or both of these items could instead be given away without charge for promotional purposes. It should also be noted that while the container 50 and valve actuating apparatus 52 are preferably distributed at the same time, these items could be distributed at different times so long as at some point in time the end user is in possession of both the container 50 and the valve actuating apparatus 52 for use with the housing 60. A further optional step includes identifying the container 50 as usable within the housing 60. This identification may take many forms sufficient to indicate to the end user that the container 50 and the valve actuating apparatus 52 are suitable for placement within the housing 60. For example, the container 50 could simply be affirmatively identified as intended or suited for use in an existing commercial product that is equipped with the housing 60. The identification could include written directions for using the container 50 and the valve actuating apparatus 52 and these directions could be sold with the container 50 and/or the valve actuating apparatus 52. Alternatively, the identification may be in the form of one or more pictorial diagrams that illustrate a housing having a tapered wall or diagrams of the container 50 and the valve actuating apparatus 52 in the housing 60 having the wall 61 and/or the large discharge opening 62.

INDUSTRIAL APPLICABILITY

The foregoing embodiments are useful for dispensing a variety of products such as insecticides, cleaning products, air treatment products (e.g., air fresheners), or other products.

Numerous modifications to the present invention will be apparent to those skilled in the art in view of the foregoing description. Accordingly, this description is to be construed as merely exemplary of the inventive concepts taught herein and is presented for the purpose of enabling those skilled in the art to make and use the invention and to teach the best mode of carrying out the same. The exclusive rights to all modifications which come within the scope of the appended claims are reserved.

We claim:

1. An actuator cap, comprising:

a main wall that extends generally along an axial dimension thereof and has a generally circular cross section with a varying cross sectional size;

multiple flexible actuator members integrally extending from the main wall transverse to the axial dimension, the actuator members including a central portion adapted to be attached to a valve stem, and each terminating at an outer peripheral surface wherein the outer peripheral surfaces are spaced from one another and extend laterally beyond a portion of the main wall but do not extend beyond a greatest lateral extent of the main wall; and an upright portion having a curved outer surface disposed adjacent at least one of the flexible actuator members, wherein the curved outer surface is adapted to engage with an internal surface of a housing to guide at least one of the flexible actuator members and prevent inadvertent actuation of the flexible actuator members.

2. The actuator cap of claim 1 in combination with a container, wherein the container has a maximum radial dimension and wherein the outer peripheral surfaces do not extend outwardly beyond the maximum radial dimension.

3. The actuator cap of claim 1 in combination with a container, wherein the actuator members have a length between a center of the actuator cap and respective outer peripheral surfaces greater than one-half of a radius of the container.

4. The actuator cap of claim 3, wherein the length is between about 18 mm and about 33 mm.

5. The actuator cap of claim 3, wherein the length is about 25 mm.

6. The actuator cap of claim 1 in combination with a container and a housing, wherein the housing includes a housing wall that tapers to a discharge opening wherein the discharge opening has a size larger than a radius of the container and wherein the outer peripheral surfaces are disposed in interfering relationship with the housing wall when the container and the actuator cap are disposed in the housing.

7. The combination of claim 6, wherein relative movement of the container and the housing along a longitudinal dimension of the container causes the outer peripheral surfaces to contact a surface of the housing wall, thereby displacing a valve actuating apparatus.

8. The combination of claim 6, wherein the discharge opening has a cross sectional size of about 34 mm.

9. The actuator cap of claim 1, wherein each of the actuator members comprises an arm.

10. The actuator cap of claim 1 in combination with a housing.

11. An actuator cap, comprising:

a main wall having a generally circular cross section that decreases in cross sectional size along an axial dimension defined between first and second ends of the main wall;

at least two flexible actuator members extending transversely to the axial dimension, the actuator members including a central portion adapted to be attached to a valve stem and terminating at outer peripheral surfaces wherein the outer peripheral surfaces extend laterally beyond a portion of the main wall but do not extend beyond a greatest lateral extent of the main wall; and an upright portion having a curved outer surface disposed adjacent at least one of the flexible actuator members, wherein the curved outer surface prevents inadvertent actuation of the flexible actuator members and the upright portion includes an arcuate gusset on an internal surface thereof.

12. The actuator cap of claim 11, wherein the upright portion aligns the actuator members with a discharge opening of a housing.

13. The actuator cap of claim 11, wherein the actuator members have a length of between about 18 mm and about 33 mm between a center of each actuator member and a respective outer peripheral surface.

14. The actuator cap of claim 13, wherein the length is about 25 mm.

15. The actuator cap of claim 11, further including an inner circumferential wall that is adapted to receive a valve stem.

16. The actuator cap of claim 15, wherein ribs are provided within the circumferential wall to engage the valve stem.

17. The actuator cap of claim 11, including a circumferentially inwardly-tapered flange that is adapted to snap fit over a container.

18. An actuator cap and housing therefor, comprising:

a main wall that extends generally along an axial dimension thereof, has a generally circular cross section, and has a varying cross sectional size;

at least two flexible actuator members extending transversely to the axial dimension and terminating at outer peripheral surfaces wherein the outer peripheral surfaces extend laterally beyond a portion of the main wall but do not extend beyond a greatest lateral extent of the main wall;

an upright portion having a curved outer surface disposed adjacent at least one of the actuator members, wherein the curved outer surface is engageable with an internal surface of the housing to guide the flexible actuator members and prevent inadvertent actuation of the flexible actuator members; wherein the housing includes a housing wall that tapers to a discharge opening and is adapted to secure a container therein that has a radius smaller than the discharge opening such that the outer peripheral surfaces are disposed in interfering relationship with the housing wall when the container and the actuator cap are disposed in the housing.

19. The actuator cap of claim 18, wherein relative movement of the container and the housing along a longitudinal dimension of the container causes at least one of the outer peripheral surfaces to contact a surface of the housing wall, thereby displacing a valve actuating apparatus.

20. The actuator cap of claim 18, wherein the wall of the actuator cap is circumferential.

* * * * *